US006599059B2

(12) United States Patent
Calandra, Jr. et al.

(10) Patent No.: US 6,599,059 B2
(45) Date of Patent: Jul. 29, 2003

(54) THREE-PRONG SHELL

(75) Inventors: Frank Calandra, Jr., Pittsburgh, PA (US); John C. Stankus, Canonsburg, PA (US); Brandon Demrey, Pittsburgh, PA (US); Jack R. Eaton, Oakmont, PA (US); Larry Boozer, Mount Joy, PA (US)

(73) Assignee: Jennmar Corporation, Pittsburgh, PA (US)

( * ) Notice: Subject to any disclaimer, the term of this patent is extended or adjusted under 35 U.S.C. 154(b) by 0 days.

(21) Appl. No.: 09/825,798

(22) Filed: Apr. 4, 2001

(65) Prior Publication Data

US 2002/0025230 A1 Feb. 28, 2002

Related U.S. Application Data

(60) Provisional application No. 60/194,525, filed on Apr. 4, 2000.

(51) Int. Cl.[7] ..... E21D 21/00

(52) U.S. Cl. ..... 405/259.4; 405/259.5; 411/44

(58) Field of Search ..... 405/259.1, 259.3, 405/259.4, 259.5; 411/54, 55, 44, 49, 60.2, 63–68

(56) References Cited

U.S. PATENT DOCUMENTS

| | | | | | |
|---|---|---|---|---|---|
| 4,011,787 | A | | 3/1977 | White et al. | 85/76 |
| 4,337,012 | A | * | 6/1982 | Sohnius | 411/67 |
| 4,413,930 | A | * | 11/1983 | Calandra, Jr. | 405/261 |
| 4,419,805 | A | * | 12/1983 | Calandra, Jr. | 405/259 |
| 4,437,795 | A | | 3/1984 | White | |
| 4,516,885 | A | * | 5/1985 | Calandra, Jr. | 405/261 |
| 4,518,292 | A | * | 5/1985 | Calandra, Jr. | 405/261 |
| 4,655,645 | A | * | 4/1987 | Hipkins, Sr. et al. | 405/261 |
| 4,764,055 | A | * | 8/1988 | Clark et al. | 405/261 |
| 4,904,123 | A | | 2/1990 | Calandra, Jr. et al. | 405/261 |
| 4,969,778 | A | | 11/1990 | Calandra, Jr. et al. | 405/261 |
| 5,078,547 | A | | 1/1992 | Calandra, Jr. et al. | 405/259.5 |
| 5,087,160 | A | | 2/1992 | Pezzutto | 411/5 |
| 5,316,414 | A | * | 5/1994 | Wright | 405/259.6 |

FOREIGN PATENT DOCUMENTS

| | | | | |
|---|---|---|---|---|
| CA | 668317 | | 8/1963 | |
| DE | 268365 | | 2/1969 | |
| DE | 84 08 639 4 | | 7/1984 | |
| DE | 197 07 542 A 1 | | 8/1998 | |
| GB | 2048419 A | * | 12/1980 | F16B/13/06 |

OTHER PUBLICATIONS

Birmingham Bolt Co., Reliable Point Anchor Systems.
Frazer & Jones Division of the Eastern Company, Mine Roof Support Anchors, 1995 Edition.

* cited by examiner

*Primary Examiner*—Thomas B. Will
*Assistant Examiner*—Alexandra K Pechhold
(74) *Attorney, Agent, or Firm*—Webb Ziesenheim Logsdon Orkin & Hanson, P.C.

(57) ABSTRACT

An expansion assembly configured to be attached to a mine roof bolt, wherein the expansion assembly may include a plug defining an interior cavity and an outer surface and an expansion shell having a plurality of spaced-apart prongs, preferably three prongs, and defining a plurality of shell grooves, wherein each of the spaced-apart prongs is oriented diametrically opposed to a corresponding shell groove.

15 Claims, 3 Drawing Sheets

THREE-PRONG SHELL

CROSS-REFERENCE TO RELATED APPLICATION

This application claims the benefit of earlier filed U.S. Provisional Patent Application Ser. No. 60/194,525, filed Apr. 4, 2000, and entitled "Improved Three-Prong Shell".

BACKGROUND OF THE INVENTION

1. Field of the Invention

The present invention relates to an improved expansion assembly for mine roof bolts used in relatively-small diameter holes and, more particularly, to expansion assemblies that can be used with or without resin-bonding materials.

2. Brief Description of the Prior Art

Examples of four-prong mine roof bolt expansion shell assemblies used in one-inch diameter mine roof bore holes are disclosed in U.S. Pat. Nos. 4,904,123; 4,969,778; and 5,078,547, all herein incorporated by reference in their entirety and all assigned to the assignee of the present invention.

In general, four-prong mine roof bolt expansion shell assemblies include a plug, which is attached to a mine roof bolt in mine roof support applications, and a four-prong expansion shell that slidingly engages the plug.

In one commercial embodiment, the plug has a height of approximately 1 3/16 inches, an outside diameter of approximately 0.9 inches, and is made from ASTM A220 Grade 50005 pearlitic malleable iron. The plug has approximately 6.5 degrees of side taper, with the length of taper being approximately one inch. Internally-defined threads are provided for attaching the plug to a mine roof bolt, wherein the threads are generally 5/8 inch, 11 per ASTM F432-95.

The plug defines four resin grooves spaced ninety degrees apart with respect to each other, with each resin groove being approximately 0.074 inch deep and approximately 0.268 inch wide. The plug further defines a number twelve through hole that receives a wooden shear pin which acts as a delay mechanism. The total area of resin grooves is approximately 0.040 square inch, and the total area for resin flow in a substantially one-inch diameter bore hole is approximately 0.117 square inch.

The four-prong expansion shell generally has four prongs and an inside square taper leave. The four-prong expansion shell is preferably made from ASTM A47 Grade 32510 ferritic malleable iron, has a height of approximately 2 11/32 inches, and an outside diameter of approximately 15/16 inch. The degree of inside taper leave is approximately 6.5 degrees, and the length of taper is approximately 39/64 inch. The four prongs define four grooves spaced ninety degrees apart, with each groove width being approximately 1/4 inch and each groove length being approximately 2 1/16 inches. The inside diameter of the four-prong expansion shell is approximately 21/32 inch. Each of the four prongs define approximately eight total serrations spaced approximately 3/16 inch apart with respect to one another, with three serrations at ten degrees and five serrations at twenty degrees. The total serrated surface area of all of the four prongs is 3.483 square inches.

Given the fact that the bore hole diameter is fixed in small bore applications to approximately one inch, there is little flexibility with respect to the diameter of the expansion shell. However, there is an ever present need to secure small diameter bore hole mine roof bolts in mine roofs such that the bolts will resist higher stress loads.

SUMMARY OF THE INVENTION

One embodiment of the present invention generally includes an expansion assembly configured to be attached to a mine roof bolt. The expansion assembly may include a plug defining an interior cavity and an outer surface and an expansion shell having a plurality of spaced-apart prongs and defining a plurality of shell grooves, wherein each of the spaced-apart prongs is oriented diametrically opposed to a corresponding shell groove. In one configuration, the expansion shell is positioned adjacent to the outer surface of the plug and is slideably movable with respect to the plug.

The plug may generally define an internal cavity, define threads in the internal cavity, define three resin grooves spaced about 120 degrees apart, and may also define a side extension that extends along a length of the plug. The expansion shell may define only three prongs also spaced approximately 120 degrees apart and three shell grooves, and may further comprises a ring, with the three prongs integrally-formed with the ring. The expansion shell may also define eight spaced-apart serrations, with three of the serrations angled in one orientation and five of the serrations angled at a second orientation.

The present invention helps to increase the stress load resistance of small diameter mine roof bolts by providing an expansion shell assembly for small diameter bore holes, particularly one-inch diameter mine roof bore holes, wherein the plug has three resin grooves, and the expansion shell has three prongs.

The three-prong design increases the amount of surface area for resin flow, increases the total external area of the three-prong expansion shell which permits the three-prong expansion shell to set or grab the walls of the bore hole quicker (allowing a smaller support nut to be used), and is less expensive to manufacture.

These and other advantages of the present invention will be clarified in the description of the preferred embodiment taken together with the attached drawings in which like reference numerals represent like elements throughout.

DETAILED DESCRIPTION OF THE PREFERRED EMBODIMENT

An expansion assembly 10 according to the present invention is shown generally in FIGS. 1–9, and further described in U.S. Provisional Patent Application Serial No. 60/194,525, filed Apr. 4, 2000, herein incorporated by reference in its entirety.

Figure 1:
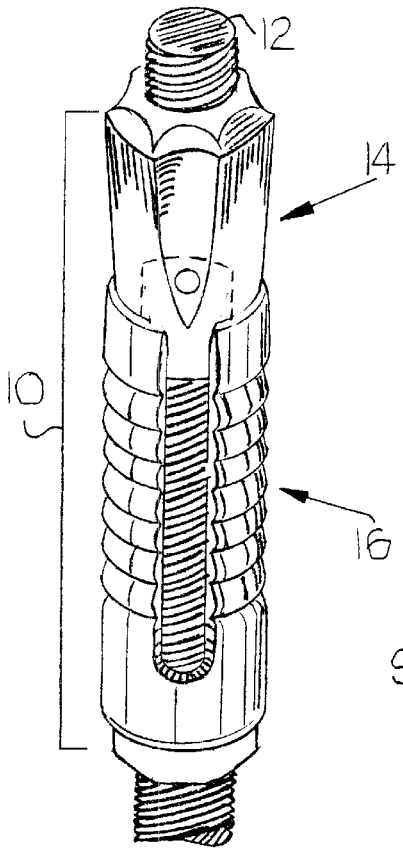
FIG. 1 is a perspective view of an expansion assembly installed on a mine roof bolt according to one embodiment of the present invention.

As shown in FIG. 1, the expansion assembly 10 is usually positioned on a mine roof bolt 12, such as a cable bolt, solid bolt, or combination bolt. The expansion assembly 10 generally includes a plug 14 and a three-prong expansion shell 16.

Figure 2:
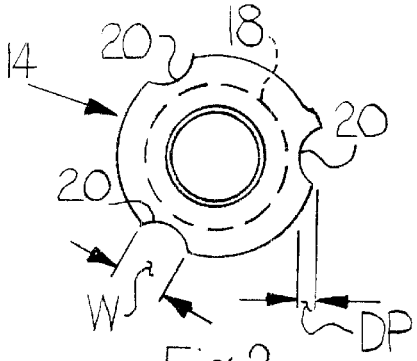
FIG. 2 is an end view of a plug.
Figure 3:
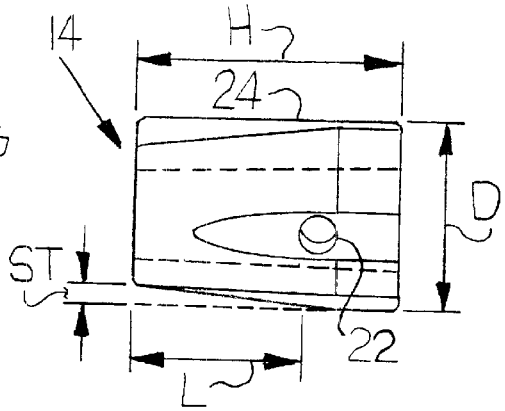
FIG. 3 is a side view of the plug shown in FIG. 2.

The plug 14, shown in greater detail in FIGS. 2–3, is preferably made from ASTM A220 Grade 50005 pearlitic malleable iron. As shown in FIG. 2, the plug 14 defines an internal cavity 17 which defines internal threads 18, with the threads 18 preferably being ⅝ inch, 11 per ASTM F432-95. The plug 14 further defines three resin grooves 20 spaced about 120 degrees apart, with the depth DP of each resin groove 20 being about 0.075 inch and the width W of each resin groove 20 being about 0.192 inch. The total cross-sectional area of each of the resin grooves 20 is approximately 0.04 square inch.

As shown in FIG. 3, the plug 14 generally has a height H of about 15⁄16 inches and an outside diameter D of about 0.9 inch. The degree of side taper ST is approximately 6.5 degrees and the length L of the taper is approximately one inch. A through hole 22 (preferably number twelve in size) is defined by the plug 14 for receiving a wooden shear pin (not shown), which acts as a delay mechanism during rotation of the mine roof bolt 12 shown in FIG. 1. With continuing reference to FIG. 3, a side extension 24 extends along the height H of the plug 14 for resisting relative rotation between the three-prong expansion shell 16 and the plug 14.

Figure 4:
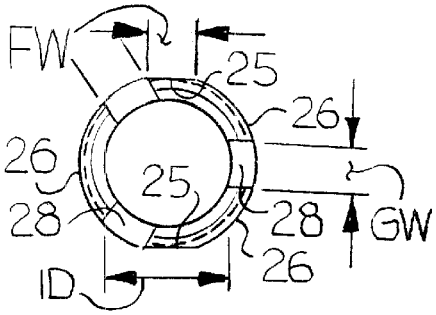
FIG. 4 is an end view of an expansion shell having only three prongs.

As shown in FIG. 4, the three-prong expansion shell 16 is preferably made from ASTM A47 Grade 32510 ferritic malleable iron, has three prongs or leaves 26, and may further define one or more substantially flat surfaces 25 approximately 0.4 inch in width FW. The prongs 26 define three shell grooves 28 spaced about 120 degrees apart and substantially diametrically opposed to a corresponding one of the three prongs 26, with the shell groove width GW being about ¼ inch. The internal diameter ID of the three-prong expansion shell 16 is about 21⁄32 inch.

Figure 5:
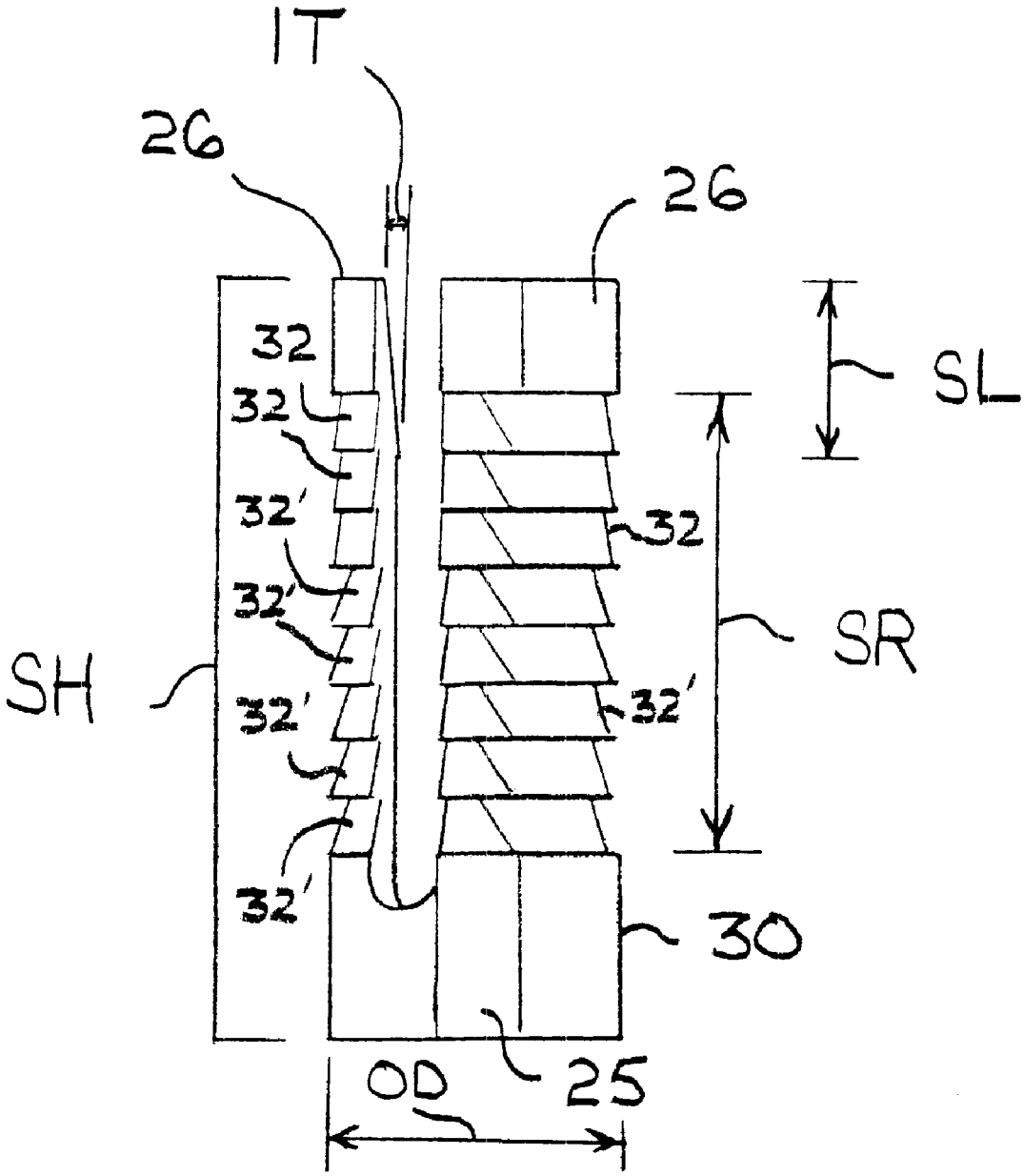
FIG. 5 is a side view of the expansion shell shown in FIG. 4.

As shown in FIG. 5, the three prongs 26 are preferably integrally formed with a ring 30 having a shell height SH of about 2 15⁄32 inches and an outside diameter OD of about 15⁄16 inch. The degree of inside taper IT is about 6.5 degrees, and the length of taper SL is about 39⁄64 inch and the groove length GL being about 2 1⁄16 inches. There are preferably eight total serrations SR spaced about 3⁄16 inch apart, with three serrations 32 angled at ten degrees from vertical and five serrations 32' angled at twenty degrees from vertical. The total external surface area of the three-prong expansion shell 16 is approximately 3.978 square inches in this configuration.

Figure 6:
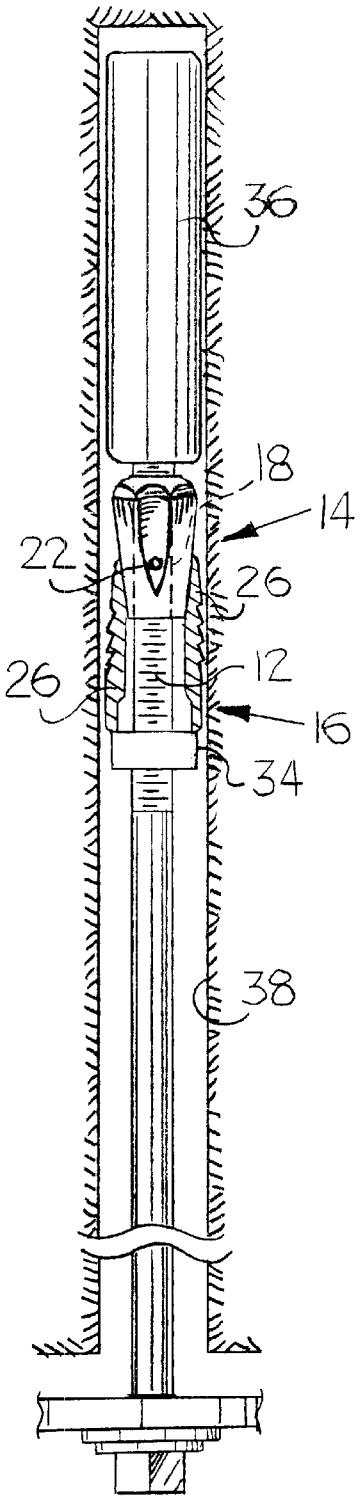
FIG. 6 is side view of the expansion assembly and mine roof bolt shown in FIG. 1 partially installed in a bore hole defined in a mine roof, along with resin/catalyst.

The expansion assembly 10 of the present invention may be used as follows. As shown in FIG. 6, the plug 14 is threadedly connected by the internal threads 18 to the mine roof bolt 12, with the mine roof bolt 12 preferably being ⅝ inch in diameter. The three-prong expansion shell 16 is loosely attached to the mine roof bolt 12 and held in position by a support 34. The support 34 is preferably a cylindrically-shaped nut having an outside diameter of approximately 15⁄16 inch and a thickness of approximately ⅛–⅜ inch, depending on the rigidity of the mine roof strata. For example, if the mine roof strata is weak, a thicker support is generally required. If the mine roof strata is more substantial, a thinner thickness may be used. Curable resin/catalyst 36 is inserted into a bore hole 38. The mine roof bolt 12 is then rotated to mix the resin/catalyst 36 and cause the plug 14 to thread downwardly on the mine roof bolt 12, shown by arrow A1, until the plug 14 contacts the shear pin (not shown) received by the through hole 22. The three-prong expansion shell 16 rotates with the mine roof bolt 12. As the resin/catalyst 36 cures and hardens, the plug 14 and the shell 16 are prevented from rotating. Further rotation of the mine roof bolt 12 causes the plug 14 to snap through the shear pin, and the plug 14 is further urged downwardly on the mine roof bolt 12. The tapered plug 14 expands the prongs 26 of the three-prong expansion shell 16 as the shell 16 slides over the plug 14, forcing the prongs 26 to firmly grasp a surface of the bore hole 38.

Figure 7:
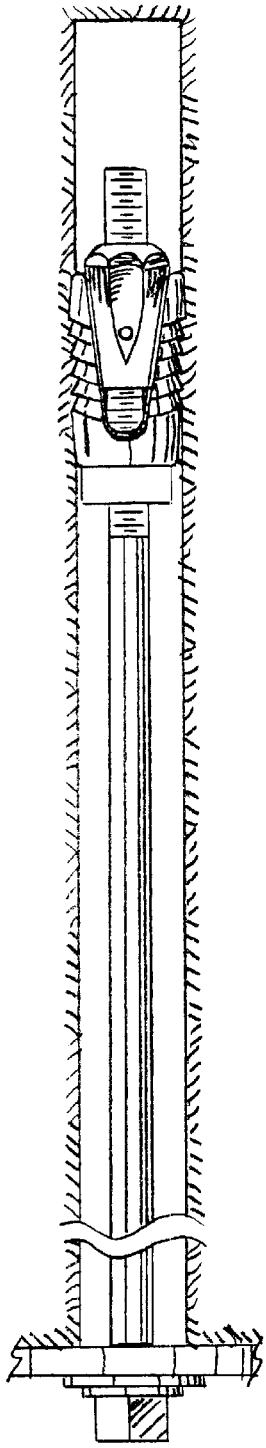
FIG. 7 is a side view of the expansion assembly and mine roof bolt shown in FIG. 6 installed in the mine roof.

As shown in FIG. 7, once the three-prong expansion shell 16 sets firmly against or into the bore hole 38, the mine roof bolt 12 is tensioned. When resin/catalyst 36 is not used, the shear pin is not required.

Figure 8:
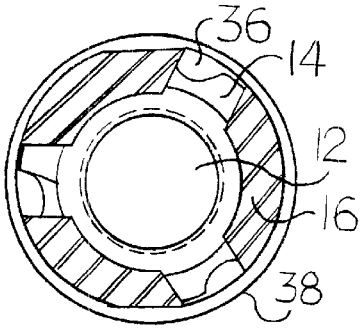
FIG. 8 is an end view of the mine roof bolt and expansion assembly shown in FIGS. 6 and 7, along with a resin/catalyst flow pattern.
Figure 9:
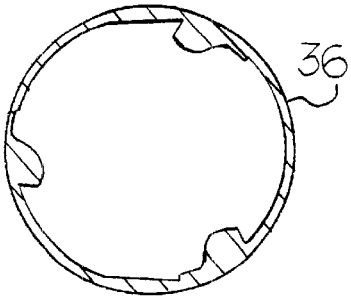
FIG. 9 is an isolated view of the resin/catalyst flow pattern shown in FIG. 8.

FIG. 8 shows the plug 14 and the three-prong expansion assembly 16 described in connection with FIGS. 1–7 and the mine roof bolt 12 described in connection with FIGS. 6–7 installed in a bore hole 38, along with resin/catalyst 36. FIG. 9 is a isolated view of the resin/catalyst 36 pattern shown in FIG. 8. As illustrated in either FIG. 8 and FIG. 9, the total cross-sectional area of the resin/catalyst pattern is approximately 0.142 square inches.

The results of pull test bolt head deflections conducted at the Ohio Valley Company Powhatan No. 6 Mine are summarized in Table 1, entitled Pull Test Results. Prior to the pull tests, a series of approximately one-inch bore holes were drilled into mine roof of the No. 6 mine. Next, a series of INSTAL B brand of mine roof bolts, commercially available from Jennmar Corporation of Pittsburgh, Pa., were each configured with an expansion assembly 10 according to the present invention. FOSROC brand of resin/catalyst was then inserted into each bore hole, followed by corresponding mine roof bolt. Each bolt was then installed and tensioned in the manner described above.

TABLE 1

PULL TEST RESULTS

| | Bolt Head Deflection (in inches) | | | |
|---|---|---|---|---|
| LOAD (in tons) | Bolt #1 | Bolt #2 | Bolt #3 | Bolt #4 |
| 0 | 0.000 | 0.000 | 0.000 | 0.000 |
| 1 | 0.000 | 0.000 | 0.000 | 0.000 |
| 2 | 0.000 | 0.000 | 0.000 | 0.000 |
| 3 | 0.016 | 0.014 | 0.012 | 0.015 |
| 4 | 0.029 | 0.025 | 0.024 | 0.031 |
| 5 | 0.052 | 0.054 | 0.049 | 0.054 |
| 6 | 0.083 | 0.077 | 0.074 | 0.084 |
| 7 | 0.106 | 0.104 | 0.099 | 0.110 |
| 8 | 0.140 | 0.140 | 0.125 | 0.150 |
| 9 | 0.175 | 0.189 | 0.164 | 0.186 |
| 9 | 0.239 | 0.235 | 0.221 | 0.254 |

As illustrated above, the present invention increases the amount of surface area for resin flow on the exterior of the expansion shell, increases the total external surface are of the three-prong expansion shell which permits the three-prong expansion shell to set or grab the walls of the bore hole more efficiently, and is less expensive to manufacture.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

We claim:

1. An expansion assembly configured to be attached to a mine roof bolt, the expansion assembly comprising:

a plug, the plug defining an interior cavity and an outer surface;

an expansion shell having only three prongs and defining three shell grooves, wherein the expansion shell is positioned adjacent to the outer surface of the plug and is slideably movable with respect to the plug; and a support positioned on the mine roof bolt adjacent to the expansion assembly but not integrally formed with the expansion shell, the support having a thickness selected from a range consisting of approximately one-eighth of an inch and three-eighths of an inch, wherein the thickness of the support is selected depending on mine roof strata conditions and a set time of at least one of the three prongs.

2. The expansion assembly as claimed in claim 1, wherein the plug defines three resin grooves spaced about 120 degrees apart.

3. The expansion assembly as claimed in claim 2, wherein the total cross-sectional area of resin grooves is approximately 0.04 square inch.

4. The expansion assembly as claimed in claim 2, wherein the total cross-sectional area for resin flow in the mine roof bore hole approximately one inch in diameter is approximately 0.142 square inch.

5. The expansion assembly as claimed in claim 2, wherein the depth of each resin groove is approximately 0.075 inch, and the width of each resin groove is approximately 0.192 inch.

6. The expansion assembly as claimed in claim 1, wherein the plug further defines a side extension that extends along a length of the plug.

7. The expansion assembly as claimed in claim 1, wherein the plug defines internal threads in the internal cavity.

8. The expansion assembly as claimed in claim 1, wherein the expansion shell further comprises a ring, and the only three prongs are integrally-formed with the ring.

9. The expansion assembly as claimed in claim 1, wherein the only three prongs define three shell grooves spaced about 120 degrees apart.

10. The expansion assembly as claimed in claim 9, wherein each of the three shell grooves has a groove width of about ¼ inch and a groove length of about 2 1/16 inches.

11. The expansion assembly as claimed in claim 1, wherein the expansion shell defines eight serrations spaced about 3/16 inch apart, with three of the serrations angled at ten degrees from vertical and five of the serrations angled at twenty degrees from vertical.

12. The expansion assembly as claimed in claim 1, wherein the expansion shell defines an expansion shell exterior, and the expansion shell exterior has an external surface area of about 3.978 square inches.

13. A mine roof bolt anchoring system comprising:

a mine roof defining a substantially one-inch bore hole;

a mine roof bolt configured to be received in the substantially one-inch bore hole, an expansion assembly positioned on the mine roof bolt, the expansion assembly comprising:

a plug defining an interior cavity and an outer surface; and an expansion shell having a plurality of spaced-apart prongs, defining a plurality of shell grooves, and having an outside diameter of approximately nine-tenths of an inch, wherein each of the spaced-apart prongs is oriented diametrically opposed to a corresponding shell groove, wherein the expansion shell is positioned adjacent to the outer surface of the plug and is slideably movable with respect to the plug; and a support positioned on the mine roof bolt adjacent to the expansion assembly but not integrally formed with the expansion shell, the support having a thickness selected from a range consisting of approximately one-eighth of an inch and three-eighths of an inch, wherein the thickness of the support is selected based upon strata composition of the mine roof and a set time of at least one of the three prongs.

14. The expansion assembly as claimed in claim 13, wherein the plug defines three resin grooves spaced about 120 degrees apart.

15. The expansion assembly as claimed in claim 13, wherein the plug further defines a side extension that extends along a length of the plug.

* * * * *

UNITED STATES PATENT AND TRADEMARK OFFICE

CERTIFICATE OF CORRECTION

PATENT NO. : 6,599,059 B2
DATED : July 29, 2003
INVENTOR(S) : Frank Calandra, Jr. et al.

It is certified that error appears in the above-identified patent and that said Letters Patent is hereby corrected as shown below:

Column 3,
Line 25, "15/16 inches" should read -- 1 5/16 inches --.

Column 4,
Line 31, "Ohio Valley Company" should read -- Ohio Valley Coal Company --.

Column 6,
Line 17, "hole," should read -- hole; --.

Signed and Sealed this

Second Day of December, 2003

JAMES E. ROGAN
*Director of the United States Patent and Trademark Office*